US006848811B2

(12) United States Patent
Langevoort et al.

(10) Patent No.: US 6,848,811 B2
(45) Date of Patent: Feb. 1, 2005

(54) REFLECTOR LAMP

(75) Inventors: Jereon Christiaan Langevoort, Nijmegen (NL); Bruno Thoenessen, Simmerath (DE); Eva Maria Siegert, Radeberg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/161,752

(22) Filed: Jun. 4, 2002

(65) Prior Publication Data

US 2003/0058651 A1 Mar. 27, 2003

(30) Foreign Application Priority Data

Jun. 8, 2001 (DE) ..... 101 27 975

(51) Int. Cl.[7] ..... F21V 17/04
(52) U.S. Cl. ..... 362/306; 362/226; 362/549
(58) Field of Search ..... 362/226, 549, 362/310, 296, 306, 341; 313/318.11

(56) References Cited

U.S. PATENT DOCUMENTS 4,403,276 A * 9/1983 Blaisdell ..... 362/226
4,982,132 A * 1/1991 Meyer et al. ..... 313/113
5,119,282 A * 6/1992 Meyer et al. ..... 362/306
6,215,236 B1 * 4/2001 Gotoh et al. ..... 313/318.07

FOREIGN PATENT DOCUMENTS

DE 29910604 10/1999 ..... H01K/7/02

* cited by examiner

*Primary Examiner*—Laura K. Tso
(74) *Attorney, Agent, or Firm*—Ernestine C. Bartlett

(57) ABSTRACT

The invention relates to a reflector lamp at least comprising a bulb (1) having a closure (2) from which at least one current conductor (3) extends to the exterior, and a reflector (4) having at least a reflecting contour (5) and a reflector neck (6), wherein the closure (2) is arranged in the reflector neck (6), and at least one current conductor (3) is passed through the bottom (7) of the reflector neck (6), while the bulb (1) is supported in the interior of the reflector neck (6) by means of contact surfaces (8), and all current conductors (3) are passed through the bottom (7) of the reflector neck (6).

10 Claims, 3 Drawing Sheets

REFLECTOR LAMP

Figure 1:
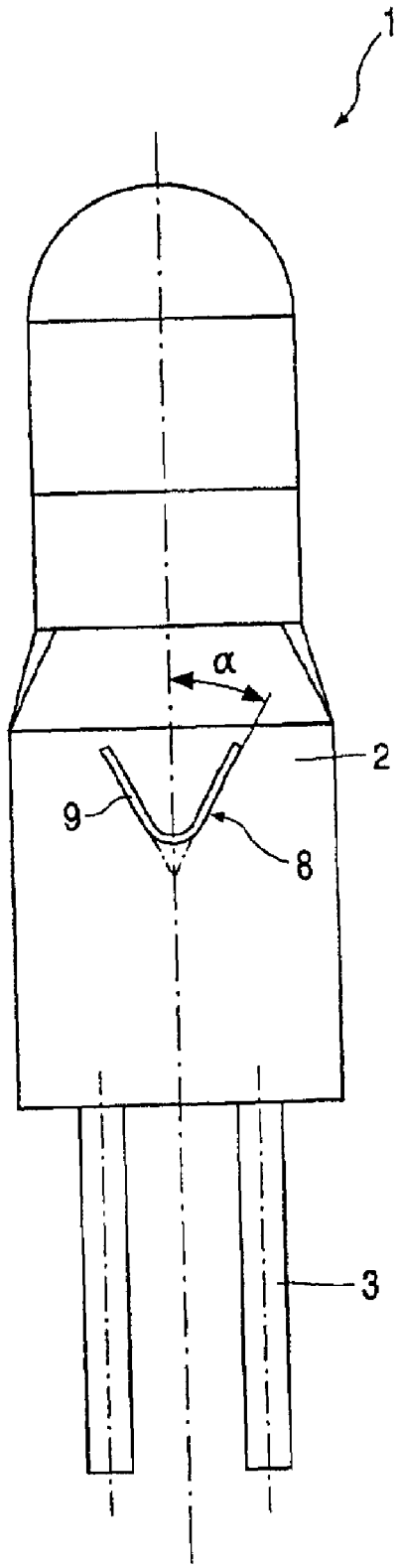

The invention relates to a reflector lamp at least comprising a bulb which has a closure from which at least one current conductor is passed to the exterior, and a reflector which has at least a reflecting contour and a reflector neck, said closure being arranged in the reflector neck, while at least one current conductor is passed through the bottom of the reflector neck.

Such a reflector lamp is known, for example, from DE 299 10 604 U1. The reflector lamp described therein has a disc-shaped lamp support which is connected to the bulb and which is supported in the region of the reflector neck. The closure of the glass bulb, which has projecting studs, is fixedly connected to the lamp support after insertion into the I-shaped recess therein in that fastening tags are locked behind said studs. The tags, which are in connection with the closure under pre-stress, provide for a heat removal from the lamp, which is one of the factors determining the useful life of the reflector lamp, to an insufficient degree only.

Fastening of the lamp support disc in the reflector neck is effected by so-termed prefocusing means at the lamp support, which cooperate with raised portions in the reflector neck. A reliable assembly of lamp support and bulb is complicated and can be automated in mass manufacture with difficulty only, especially if a sufficiently good lighting quality is to be achieved by means of a defined positioning on the reflector axis.

It is an object of the invention to provide a reflector lamp which can be manufactured partly or wholly automatically in a technologically simple and inexpensive manner, whereby a satisfactory lighting quality and life of the reflector lamp are safeguarded.

The object of the invention is achieved by means of a reflector lamp at least comprising a bulb which has a closure, from which at least one current conductor is passed to the exterior, and a reflector which has at least a reflecting contour and a reflector neck, wherein the closure is arranged in the reflector neck, and the bulb is directly supported in the interior of the reflector neck, while all current conductors are passed through the bottom of the reflector neck.

The invention renders it possible to provide a reflector lamp whose main components, i.e. in particular the lamp bulb having a closure and the reflector comprising at least a reflecting contour and a reflector neck, can be manufactured independently of one another and can subsequently be connected to one another partly or wholly automatically in a simple manner.

The secure and locally defined connection of reflector and bulb is achieved basically without an additional component of complicated construction such as, for example, the known lamp support from the prior art. This reduces the number of components required or replaces them with simple means, reduces the cost of manufacture, and utilizes resources more effectively. The advantages of a so-termed cementless construction as described in DE 299 10 604 U1 are further enhanced thereby.

A further effect of the invention is that the suitable selection, dimensioning, and shaping of the contacting means for an interlocking connection between the closure of the bulb and the region lying inside the reflector neck render possible a concrete embodiment of the solution according to the invention tailored to the respective application or lamp type. The dimensioning, in particular the choice of size of the contact surfaces, has inter alia a direct influence on the thermal conduction behavior inside the reflector lamp, i.e. in particular on the desired heat removal from the bulb to the reflector. The contacting means according to the invention for achieving an interlocking connection may be chosen from known means such that a self-adjusting and reliable positioning is safeguarded during mounting, in particular by means of shaking.

The solution according to the invention in addition renders possible a simple and accurate adjustment with respect to the focus which is defined by the reflector axis and the reflecting surface. The invention relates to reflector lamps pinched at one or two sides, or bulbs by molding. The lamp base used may be, for example, a conventional metal, glass, or ceramic base as well as a dual-pin base.

Reflector lamps within the scope of the invention are all known lamp types having a reflector, such as temperature radiators, discharge lamps, and halogen lamps.

The reflector according to the invention then consists of usual materials such as glass, metal, and/or synthetic resin. The reflecting contour may be coated with usual reflecting materials. A suitable glass or quartz material is used for the bulb.

The solution according to the invention makes available a reflector lamp which can be used in the private as well as the professional field at all usual mains voltages, which is to be understood as being a range from approximately 60 V to 250 V, and with various power ratings. The invention is equally applicable to reflector lamps designed for operation at low voltages (below 60 V).

The assembly of the bulb and reflector of the reflector lamp according to the invention will comprise the following steps, in particular in the case of a partly or wholly automated manufacture: the reflector is inserted into an automatic machine, preferably vertically, and a bulb is introduced into the reflector from above, in particular with its closure into the inner space of the reflector neck. Then the reflector is shaken. This shaking movement causes the current conductor of the bulb to drop automatically through the corresponding opening in the bottom of the reflector neck, said opening being preferably tapering in shape, so as to facilitate the threading of the current conductors. Simultaneously or subsequently, the contact surfaces will automatically come to lie one on the other owing to their matching shapes in the previously defined positions.

In a further step, an additional fixation between the bulb and the reflector in the direction of the reflector axis may be achieved by suitable means which are known per se and which act under force or owing to their material properties.

In a preferred embodiment of the solution according to the invention, the closure of the bulb abuts with matching shapes in the inside of the reflector neck at least by means of partial regions of the contact surfaces present in situ after the bulb and the reflector have been assembled together. The matching connection in the direction of the reflector neck bottom between partial regions of the closure and the reflector neck is realized by means of contact surfaces which at the same time serve to remove heat.

To lock the bulb against shifting in the direction of the reflector, an additional fixation is often necessary by connection means acting by means of force or their material properties. These connection means, however, may be of a simple technical construction, because all they have to do is provide a primary fixation in the direction of the reflector axis. This fixation is preferably given a resilient construction.

A further preferred embodiment of the solution according to the invention relates to contact surfaces of the corresponding contacting means which are arranged at the periphery of the closure as well as in the interior of the reflector neck. The arrangement at the periphery has the advantage that the properties for self-acting positioning during assembly are supported. This arrangement at the periphery also renders possible a technically simple manufacture of the contact surfaces with a higher surface quality in comparison with the other regions of the bulb or the interior of the reflector neck.

It is preferred that the contacting means are formed as a raised step and an accommodation space for this step, having a conical shape, and in particular having a V-shape and/or a hemispherical cross-section. A conical shape of the contacting means, with the respective raised portion and the associated accommodation space corresponding therewith in particular supports the automatic positioning during assembly to a high degree. This is also true for an arrangement in which the cross-section of the raised portion, arranged at the periphery of the closure, becomes smaller towards the bottom of the reflector, and in which the free cross-section of the corresponding accommodation space, arranged inside the reflector neck, also becomes smaller towards the bottom of the reflector.

A plurality of materials is possible for the combination of materials of reflector and bulb, in dependence in particular on the respective temperature range, for which a glass-synthetic resin, glass-metal, glass-glass, and glass-ceramic material construction are preferred as the temperature rises.

An additional fixation between the bulb and the reflector will often be required. This fixation may be achieved preferably by known means acting by means of force or their material properties, the choice of the respective means being adapted to the application in question. These means may be very simple technical means within the scope of the invention, such as, for example, mechanical locking devices such as clamps and wedges, or adhesion points, which serve in particular for the additional fixation in the direction of the reflector axis.

It is preferred that several contacting means, i.e. for example two clamps, are used, whereby the security of protection against lateral pivoting can be enhanced.

Figure 2A:
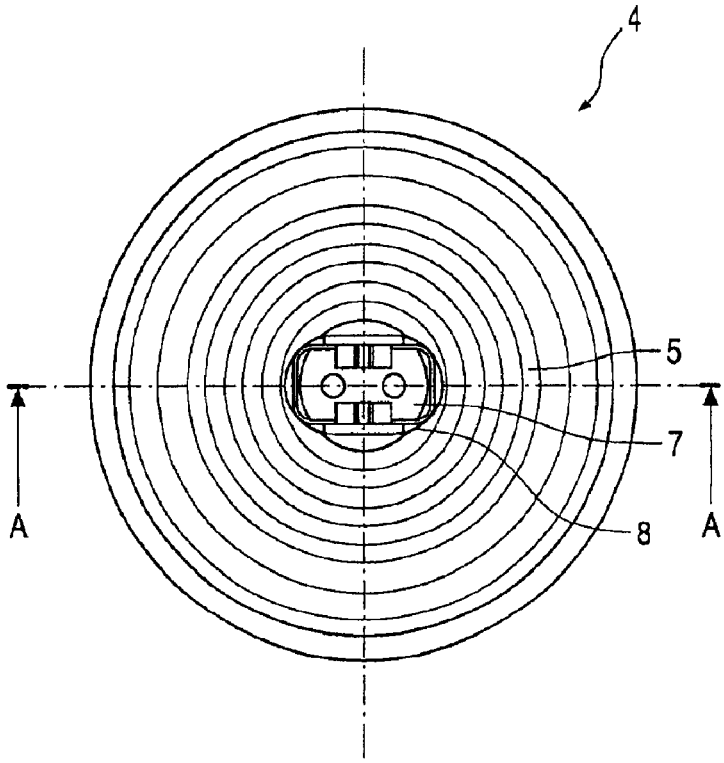
Figure 2B:
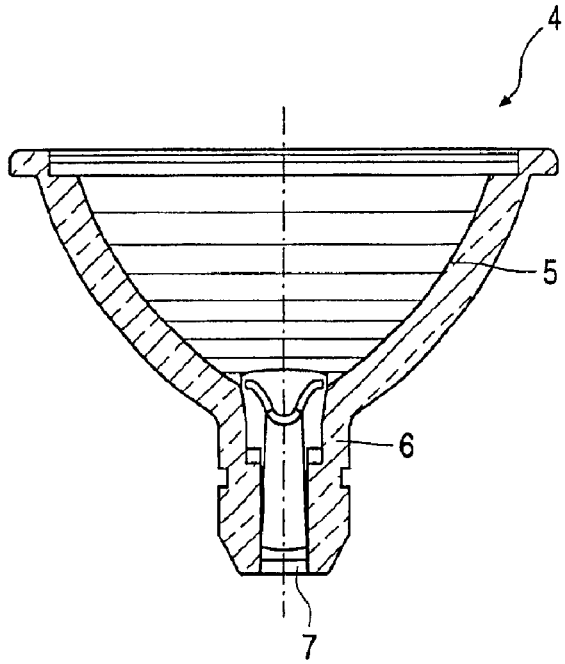
Figure 3:
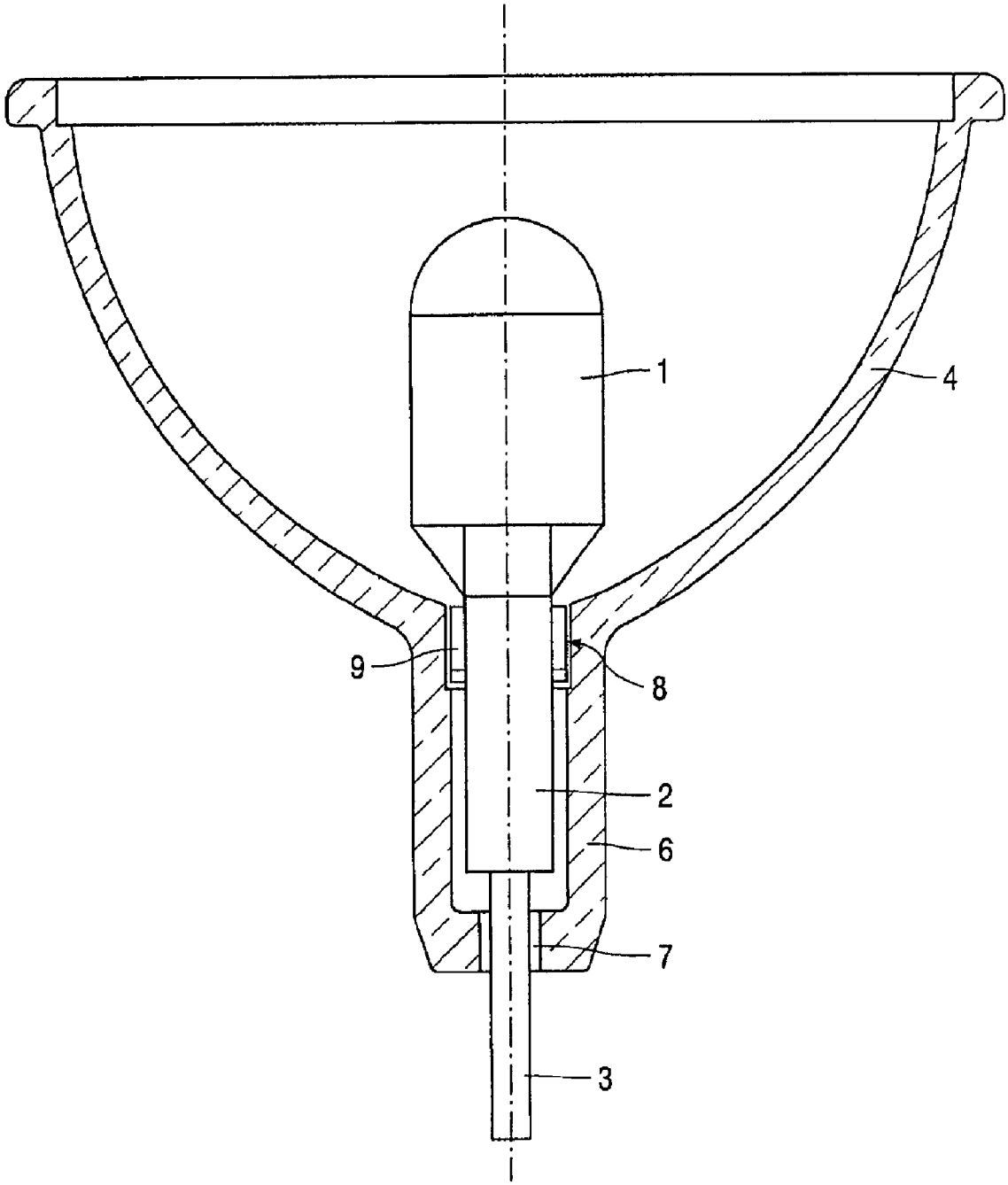

The invention will be explained in more detail below with reference to an embodiment and the drawing, in which:

FIG. 1 shows a bulb of a reflector lamp in side elevation,

FIG. 2*a* shows a reflector of a reflector lamp in plan view,

FIG. 2*b* shows the reflector of FIG. 2*a* in lateral cross-section, and FIG. 3 shows the bulb and the reflector after assembly in side elevation, partly in cross-section.

FIG. 1 shows the bulb 1 of a reflector lamp based on a halogen incandescent lamp for general lighting purposes for low voltage operation in side elevation.

The bulb 1 is made of quartz glass here and is filled with a gas mixture which is known per se, often comprising a usual halogen additive. The bulb 1 may in principle be one which has a suitable closure 2. The bulb 1, which contains an incandescent body (not shown in FIG. 1) is hermetically sealed off by means of a closure 2. A contacting means 9 projects from the substantially parallel outer surfaces of the single-sided closure 2 in a central position so as to be symmetrically arranged with respect to the lamp axis.

The contacting means 9, which is formed as a V-shaped elevation, has a contact surface 8 at each of the outer surfaces of the two legs. The conical elevation, which narrows continuously in the direction towards the current conductor 3, is rounded at this end in particular for supporting the automatic positioning during mounting. The angle enclosed by the lamp axis and a respective contact surface 8 is preferably approximately 30°, but alternative angular ranges are possible. The outer portions of the two current conductors 3 are passed from the closure 2 parallel to and symmetrically with respect to the lamp axis.

FIGS. 2*a* and 2*b* show a reflector 4 of a halogen incandescent lamp in plan view and in a lateral cross-sectional view. The reflector 4 made of glass coated with a reflecting material on the inside, having in particular a reflecting contour 5 and a reflector neck 6, has a reflector axis. Openings through which the current conductors 3 are conducted with clearance during mounting are arranged in the bottom 7 of the reflector neck 6. The clearance between the current conductors 3 and said openings is made such that an interlocking support of the bulb 1, at least by means of contact surfaces 8 arranged in partial regions of the closure 2, can be realized in the interior of the reflector neck 6. Two contacting means 9 are formed as accommodation spaces for projections in the interior of the reflector neck 6 parallel to the axis on which the two openings in the bottom 7 are arranged, as is visible in FIGS. 2*a* and 2*b*. The V-shaped accommodation spaces correspond to the projections shown in FIG. 1 as regards shape, dimensions, and positioning.

The free cross-section of each accommodation space becomes smaller continuously towards the bottom 7. The free inner space of the reflector neck 6 is dimensioned such that some clearance remains, except in the region of the contact surfaces 8, after the bulb 1 has been correctly mounted.

FIG. 3 shows the bulb 1 and the reflector 4 after mounting in side elevation and in partial cross-section; the bulb 1 has been rotated through 90° with respect to FIG. 1. The bulb 1 is directly supported in the interior of the reflector neck 6 by means of the contact surfaces 8 of the contacting means 9. The contact surfaces 8 each have a surface quality of standard glass. The two projections arranged at the periphery of the closure 2 bear on the two accommodation spaces of the reflector neck 6 with matching shapes. Owing to this desired positioning, the reflector axis and the bulb axis coincide; the incandescent body is positioned in the previously defined focus of the reflector lamp. The current conductors 3 are passed through the bottom 7 of the reflector neck 6 with some clearance. In addition to the interlocking connection described above, means for fixing the bulb 1 and the reflector 4 are provided, which means act by means of force or their material properties. In the embodiment described, for example, an additional fixation may be achieved after mounting together of the bulb 1 and the reflector 4 through adhesion of at least one current conductor 3 against the bottom 7 of the reflector neck 6, but this is not shown in FIGS. 1 to 3. Alternatively, mechanical clamping elements which are known per se and which ensure in particular a fixation in the direction of the reflector and lamp axis may be used in a simple manner.

What is claimed is:

1. A reflector lamp at least comprising a bulb which has a closure from which at least one current conductor is passed to the exterior and a reflector which has at least a reflecting contour and a reflector neck, wherein the closure is arranged in the reflector neck, while at least one current conductor is passed through the bottom of the reflector neck, the bulb having contacting means with contact surfaces arranged at the periphery of the closure and corresponding contacting means with contact surfaces in the interior of the reflector neck for supporting the bulb, and said at least one current conductor is passed through the bottom of the reflector neck, characterized in that the contact surfaces of the corresponding contacting means which are arranged at the periphery of the closure as well as in the interior of the reflector neck are adapted for self-acting positioning and support of the bulb by the reflector during assembly of the bulb and the reflector.

2. A reflector lamp as claimed in claim 1, characterized in that the support of the bulb is accomplished as a form fit in the interior of the reflector neck by means of contact surfaces, which are arranged at least in partial regions of the closure.

3. A reflector lamp as claimed in claim 2, characterized in that the form fit is achieved by means of contact surfaces of the corresponding contacting means which are arranged at the periphery of the closure as well as in the interior of the reflector neck.

4. A reflector lamp at least comprising a bulb which has a closure from which at least one current conductor is passed to the exterior and a reflector which has at least a reflecting contour and a reflector neck, wherein the closure is arranged in the reflector neck, while at least one current conductor is passed through the bottom of the reflector neck, the bulb being supported by contacting means having contact surfaces in the interior of the reflector neck, and said at least one current conductor being passed through the bottom of the reflector neck, characterized in that the contact surfaces are formed as an elevation and as an accommodation space for the elevation, having a conical shape and having in particular a V-shape and rounded at the end.

5. A reflector lamp as claimed in claim 1, characterized in that the cross-section of the elevation, which is arranged at the periphery of the closure, becomes smaller towards the bottom of the reflector, and the free cross-section of the corresponding accommodation space, which is arranged in the interior of the reflector neck, also becomes smaller towards the bottom of the reflector.

6. A reflector lamp as claimed in claim 1, characterized in that the bulb is made of glass, and the reflector is made of a material selected from the group consisting of glass, ceramic material, metal, and plastic.

7. A reflector lamp as claimed in claim 1, characterized in that means for additional fixation of the bulb and the reflector are provided.

8. A reflector lamp as claimed in claim 1, characterized in that more than one contacting means are used.

9. A reflector lamp as claimed in claim 1, characterized in that the contact surfaces of the contacting means of the bulb and the reflector have a higher surface quality in comparison with the other regions of the bulb and the interior of the reflector neck.

10. A reflector lamp at least comprising a bulb which has a closure from which at least one current conductor is passed to the exterior and a reflector which has at least a reflecting contour and a reflector neck, wherein the closure is arranged in the reflector neck, while at least one current conductor is passed through the bottom of the reflector neck, the bulb having contacting means with contact surfaces arranged at the periphery of the closure and corresponding contacting means with contact surfaces in the interior of the reflector neck for supporting the bulb, and said at least one current conductor is passed through the bottom of the reflector neck, the contact surfaces of the corresponding contacting means which are arranged at the periphery of the closure as well as in the interior of the reflector neck being adapted for self-acting positioning and support of the bulb by the reflector during assembly of the bulb and the reflector, characterized in that the contact surfaces of the contacting means of the bulb and the reflector have a higher surface quality in comparison with the other regions of the bulb and the interior of the reflector neck.

* * * * *